United States Patent [19]

Cohen

[11] Patent Number: 4,544,068

[45] Date of Patent: Oct. 1, 1985

[54] LABORATORY GLASSWARE RACK FOR SEISMIC SAFETY

[75] Inventor: Marc M. Cohen, Palo Alto, Calif.

[73] Assignee: The United States of America as represented by the Administrator of the National Aeronautics and Space Administration, Washington, D.C.

[21] Appl. No.: 523,991

[22] Filed: Aug. 16, 1983

[51] Int. Cl.[4] ..... A47B 73/00

[52] U.S. Cl. ..... 211/74; 211/126

[58] Field of Search ..... 211/74, 126; 13, 71, 211/72, 128; D24/32

[56] References Cited

U.S. PATENT DOCUMENTS

| | | | |
|---|---|---|---|
| D. 206,155 | 11/1966 | Emmitt | D24/32 |
| 570,972 | 11/1896 | Wallis | 211/74 X |
| 914,421 | 3/1909 | Jones | 211/181 X |
| 2,987,194 | 6/1961 | Burge | 211/126 |
| 3,244,288 | 4/1966 | Schreter | 211/74 |

*Primary Examiner*—Ramon S. Britts
*Assistant Examiner*—Sarah A. Lechok
*Attorney, Agent, or Firm*—Darrell G. Brekke; John R. Manning; Robert D. Marchant

[57] ABSTRACT

A rack (10) for laboratory bottles and jars for chemicals and medicines has been designed to provide the maximum strength and security to the glassware in the event of a significant earthquake. The rack (10) preferably is rectangular and may be made of a variety of chemically resistant materials including polypropylene, polycarbonate, and stainless steel. It comprises a first plurality of parallel vertical walls (14, 32, 33, 16, etc.), and a second plurality of parallel vertical walls (18, 30, 31, 20, etc.) perpendicular to the first plurality of walls. These intersecting vertical walls comprise a self-supporting structure without a bottom which sits on four legs. The top surface of the rack is formed by the top edges of all the vertical walls, which are not parallel but are skewed in three dimensions. These top edges form a grid matrix having a number of intersections (22, 24, etc.) of the vertical walls which define a number of rectangular compartments having varying widths and lengths and varying heights. The distribution of sizes and heights for the compartments (26, 28, 38, etc.) is based on a mathematical analysis and the generation of several lines on a graph which were matrixed against each other to generate a grid on a hyperbolic-paraboloid curved surface. The rack design which corresponded closely to the actual dimensions of typical laboratory glassware resulted in a one fourth section of a hyperbolic-paraboloid "umbrella." The rack can be subdivided along latitudinal or longitudinal middle partition lines so that shelf top or counter top "half modules" can be provided.

2 Claims, 8 Drawing Figures

LABORATORY GLASSWARE RACK FOR SEISMIC SAFETY

ORIGIN OF THE INVENTION

The invention described herein was made by an employee of the United States Government and may be manufactured and used by or for the Government of the United States of America for Governmental purposes without the payment of any royalties thereon or therefor.

TECHNICAL FIELD

The present invention relates generally to a rack for laboratory glassware containers and more specifically to a rack for restraining bottles, jars, and other laboratory or hospital glassware from overturning or falling in the event of a significant earthquake.

BACKGROUND OF THE INVENTION

In recent years high seismic activity in certain parts of California has prompted scientists to study the possibility that history might repeat itself and that an earthquake of serious magnitude, such as the one which occurred in San Francisco in 1906, might occur again. Such studies have in turn prompted various persons in authority, at various levels, to institute further studies as to what precautions may be taken now to minimize the effect of such an event. One area which in the past has not received sufficient attention is the possibility that a severe earthquake might possibly release dangerous gas and spill dangerous and flammable, toxic and caustic chemicals. This could cause serious problems in laboratories and hospitals, where there are stored a wide range of chemicals, many of which are certainly dangerous and highly caustic. Moreover, many of these chemicals are stored in glass bottles and jars having a wide variety of odd sizes and shapes, so that it is not easy to secure them against spillage and breakage.

The National Aeronautics and Space Administration has also conducted some studies in the area of seismic safety. At the Ames Research Center at Moffett Field, California, a study task force has delved into this subject. Among other things it was discovered that additional attention needed to be directed to the safeguarding of laboratory chemicals since no suitable restraint system has previously existed. Of course lips on shelves and sliding glass doors on cabinets furnish restraints. However, many of the glass doors on existing cabinets are made of non-tempered glass and therefore themselves constitute a potential hazard from flying glass. In fact, existing laboratory and hospital conditions are such that even an earthquake of moderate magnitude (5 plus on the Richter Scale) could cause heavy damage and injuries in chemical and medical facilities. Breakage and mixture of chemicals pose serious hazards of unanticipated toxic or flammable reactions.

Several existing types of laboratory glassware racks are found in the prior art. One such rack is the one described in U.S. Pat. No. 3,300,055 to ROHR. This device is a steep inclined plane with cylindrical receptacles extending down from the inclined planer top surface. The device has a bottom surface parallel to the top surface. The bottom side of the plane is resting on a base while the top side of the inclined plane is supported on two rather spindly legs. This device, while it can be made to accommodate bottles or jars of various sizes, would be particularly unsuited to seismic safety because of the legs, which could easily break under the force of lateral stress, causing the rack to overturn or to fall and the bottles to tilt.

A second rack for laboratory bottles is shown in U.S. Pat. No. 3,480,152 to WALSH. This is a special purpose device which stores certain unstable materials upside-down in bottles so that the material being stored accumulates at the closure end of the bottle so as to help seal the bottle against the entry of air to the inside of the bottle. Thus this particular rack would not be suitable to accommodate most laboratory chemicals and would not be suitable to promote seismic safety.

Another laboratory glassware rack in the prior art is shown by U.S. Pat. No. Design 206,155 to EMMETT. This design shows a holding tray for large numbers of test tubes. One side of the rack is higher than the other side. Thus the top surface presents an inclined plane. This device is a convenient storage rack for test tubes and would presumably accommodate test tubes of different heights, but it does not accommodate bottles or containers of more than one size or diameter and obviously did not contemplate doing so.

Still another test tube storage rack is shown by U.S. Pat. No. Design 206,324 to BROADWIN. This device shows a rectangular box without ends with a horizontal interior partition. The top, bottom, and sides all have a number of different size holes drilled through them. This device does not appear to provide very much stable security for laboratory glassware. In fact there would appear to be a great chance that bottles stored in it would fall down, slip sideways, or tilt if the rack were subjected to any unexpected motion or shaking. It seems obvious that this rack would be the antithesis of seismic safety.

Therefore, the object of this invention is to provide a versatile laboratory restraint system that will allow visibility of the contents and be adaptable in modular fashion to shelf and counter top applications. The rack should accommodate the actual dimensions of the typical glassware in well-stocked chemical laboratories, that is, it should have compartments or "cubby-holes" which are sized in direct proportions to the actual dimensions and in approximate proportions to the percentages in which the different size and shape bottles occur.

SUMMARY OF THE INVENTION

The present invention is a device for holding laboratory glassware securely to safeguard against spillage during a major earthquake. The device comprises: a base comprising a plurality of individual feet; a self-supporting structure mounted on said base comprising: a first plurality of parallel vertical walls mounted on said base and extending longitudinally along the long axis of said structure; the first said wall being level and each of said other walls being low on one end of said structure and increasing in height toward the opposite end of said structure; a second plurality of parallel walls mounted on said base and extending laterally along the shorter axis of said structure, the first of said second plurality of parallel walls being level and each of said other second plurality of walls being low on one side of said structure and increasing in height toward the opposite side of said structure, said second plurality of walls being perpendicular to said first plurality of walls and intersecting therewith, so as to form a matrix having a plurality of intersections of said perpendicular walls and a plurality of compartments formed in said structure.

BRIEF DESCRIPTION OF THE DRAWINGS

A presently preferred embodiment of the invention will now be described in detail in connection with the accompanying drawings, wherein.

DETAILED DESCRIPTION OF THE INVENTION

Figure 1:
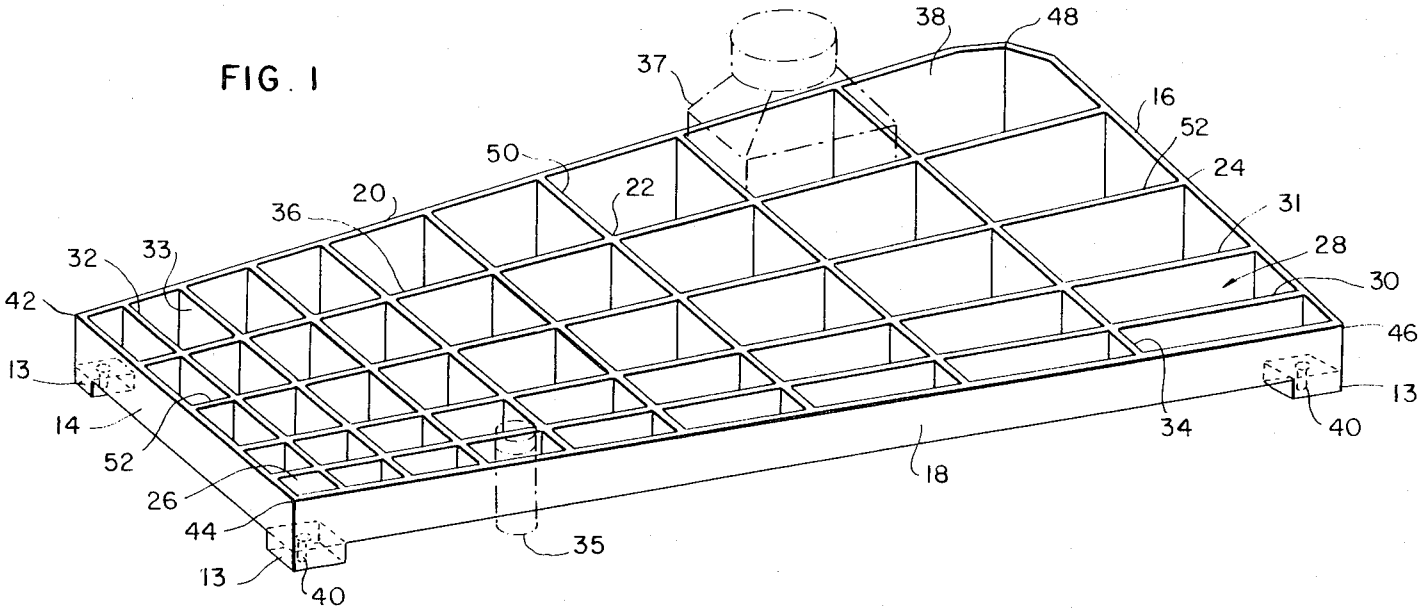
FIG. 1 is a perspective view of the invention, showing the rack as being made of an opaque material

Looking now at the perspective view of the laboratory glassware rack shown in FIG. 1 and designated generally by the numeral 10, it may be seen that this rack has a base 12 comprising several individual feet 13 supporting several exterior vertical walls, including low end wall 14, high end wall 16, front wall 18, and rear wall 20. The rack 10 has a number of interior vertical walls parallel to end walls 14 and 16 and running laterally across rack 10, and a number of interior vertical walls parallel to front and rear walls 18 and 20 and running longitudinally along rack 10. Walls 18 and 20 and the latter interior walls parallel to walls 18 and 20 are perpendicular in plan to walls 14 and 16 and the walls parallel to walls 14 and 16. The parallel lateral vertical walls and the parallel longitudinal walls intersect to form a matrix having a plurality of intersections, such for example, as intersections 22 and 24, and a plurality of compartments or "cubbyholes," such for example, as compartments 26 and 28. All of the intersecting vertical walls mentioned above constitute one self-supporting structure resting on a plurality of feet 13. Feet 13 are collectively referred to herein as base 12. Compartments, such as 26 and 28, do not have a bottom glassware in the compartment rests directly on the counter or shelf which is supporting the rack 10. This lowers the center of gravity of each restrained item with respect to the walls and makes the item more resistant to toppling. The lack of a compartment floor or bottom also facilitates clean-up when and if a chemical is accidentally spilled (from container breakage, etc.). If such an accident occurs, a washdown at the spill zone can easily be effected. For example, after a spill the containers may be removed from the rack 10 and the spill region may be flushed with water. There will be no traps for the water.

From a study of FIG. 1 it will be noted that longitudinal wall 18 is of constant height throughout its length. It will also be noted that the longitudinal walls behind 18 (30, 31, 20, etc.) are low at the front end of rack 10 (where they intersect with front end wall 14) and increase in height toward the rear end of rack 10 (where they intersect with rear end wall 16). With regard to the lateral walls, it will likewise be noted that lateral wall 14 is of a constant height throughout its length, the same height as longitudinal wall 18. The lateral walls behind lateral wall 14 (32, 33, 16, etc.) are low at the front side of rack 10 (where they intersect with the front longitudinal wall 18) and increase in height toward the rear side of rack 10 (where they intersect with the rear longitudinal wall 20). It will also be noted that the parallel vertical walls behind 18 (30, 31, 20, etc.), running longitudinally along rack 10, increase at different rates. For example, it will be noted that longitudinal wall 30 increases in height slightly as it runs from the front to the rear of rack 10. However, the next adjacent wall 31 parallel to wall 18 increases in height at a greater rate, and each successive adjacent wall increases at a rate greater than the rate for the wall before. Wall 20 increases at the greatest rate of any of the longitudinal walls. Likewise, it will be noted that the lateral wall 32 increases in height only slightly as it runs across the rack 10 from front to rear. The next adjacent parallel vertical wall 33 increases in height at a greater rate as it runs from front to rear. Each successive lateral vertical wall parallel to walls 32 and 33 increases in height at a greater rate, with end wall 16 increasing at the greatest rate of any of the parallel lateral walls.

It will be noted that, at all the intersections between perpendicular lateral and longitudinal walls, each wall of each pair of intersecting walls is at the same height at the point of intersection. The top edges of each one of the vertical intersecting walls are straight lines. However, none of these straight lines are parallel, but instead are all skewed in three dimensions. Since the different intersections of walls are not all at the same height, it may be seen that the top surface of the rack, formed by the intersections of all the perpendicular walls and by the top edges of the walls themselves, is not planar. Instead, it is a three-dimensional curved top surface, as is implicit in a surface made up of skewed straight lines. As will be discussed in detail below, the curved top surface is a portion of a hyperbolic paraboloid.

Studying FIG. 1 still further, it will be noted that lateral walls 14 and 32 are comparatively close together, but that each successive pair of adjacent lateral walls are further apart, with lateral walls 34 and 16 being the furthest apart. Likewise, it will be noted that longitudinal walls 18 and 30 are comparatively close together but that each successive pair of adjacent longitudinal walls are further apart, with longitudinal walls 36 and 20 being the furthest apart.

Therefore, as may be easily seen in viewing FIG. 1, compartments are small at the left front of the rack since the vertical walls are close together there, and the vertical compartment walls are comparatively low. Viewing the rack from the angle shown in FIG. 1, as one's view moves to the right and to the rear of the rack, the interior vertical walls are further apart and also increase in height, so that in the corner of the rack diagonally opposite to compartment 26, it may easily be seen that compartment 38 is the largest compartment and that it also has the highest walls. Rack 10 is preferably fabricated from a chemically resistant material (either transparent or opaque) which may be, for example, polypropylene, polycarbonate, or stainless steel. It is preferably secured to its support (laboratory counter, bench top, shelf, etc.) by screws or bolts inserted in holes 40 in feet 13. It should be understood that the wall thickness will depend on the type of material chosen and that the wall thickness depicted in the drawings is symbolic and nonscalar.

Referring again to FIG. 1, it may be seen that the three low outside corner points (42, 44, and 46) are all coplanar and parallel to the plane of the base (counter top). The fourth corner 48 (or "high" corner, although it is clipped off for safety purposes) represents the point of "twist" that is required for a "hy-par" curved surface. Taken as a whole, the surface can be described as a quarter-section of a hyperbolic paraboloid "umbrella."

The end result of the above described physical arrangement for the invention is that this invention provides a rack which is designed to accommodate laboratory bottles and other glassware in the exact sizes and approximate numbers in which they are found in laboratories and hospitals. Not only does the rack provide a physical solution to properly restraining bottles and jars of chemicals, both liquid and solid, but it provides a mathematical solution to storage of all jars by a design based on the basic sets of proportions of base diameter and height, and anticipating the probability of the occurrence of the different sizes and shapes. Examples of different bottles accommodated by rack 10 are the small round bottle 35 and the large bottle 37 having a rectangular cross-section.

In the design of this invention, a survey of all glassware was undertaken at a typical well-equipped laboratory at the Ames Research Center of the National Aeronautics and Space Administration. All of the glassware was measured for width and height, frequency of occurrence and physical state of contents (solid or liquid). The results were tabulated and major clusters of data points were identified. The clusters were then plotted on a graph of height versus width and the concentrations of these points consolidated. This plot showed two basic straight line distributions for bottle-jar dimensions with a rough correlation to number of containers. These two straight line plots of glassware plan dimensions for base dimension vs. height were then matrixed against each other, with the upper and lower extreme values being neglected. When height of the upper third point of the containers was correlated in the third dimension of the grid, a hyperbolic-paraboloid curved surface was generated. The grid lines are embodied in the hyperbolic-paraboloid curved surface described by the top edges of the partitions between compartments. The physical state of the bottle contents was not found to be significant.

Figure 2:
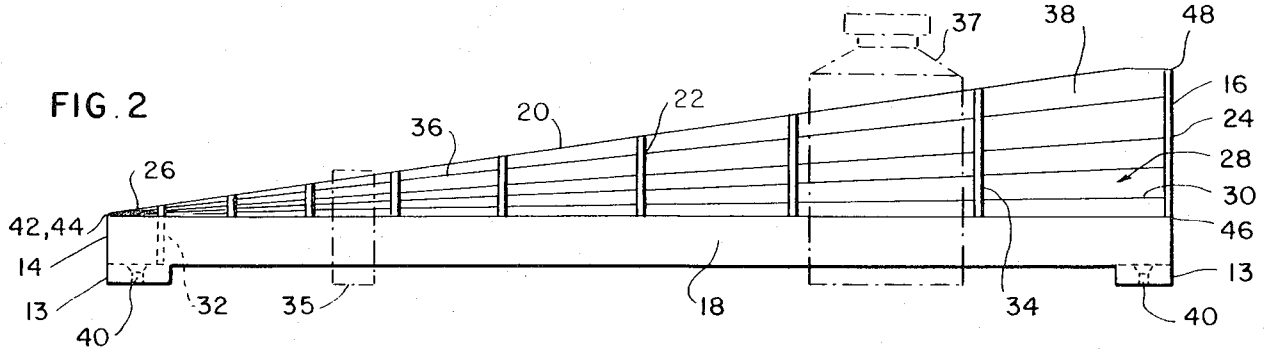
FIG. 2 is a front view of the invention.
Figure 3:
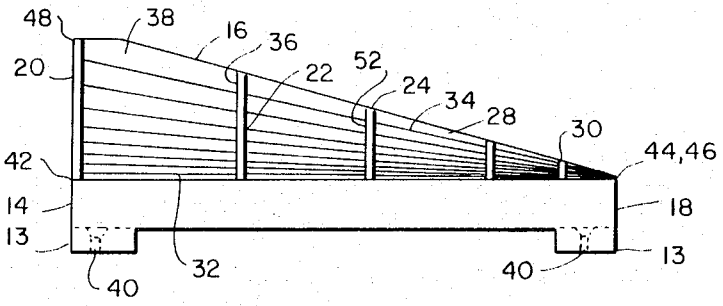
FIG. 3 is a side view of the invention, shown in larger scale than for FIG. 2.
Figure 4:
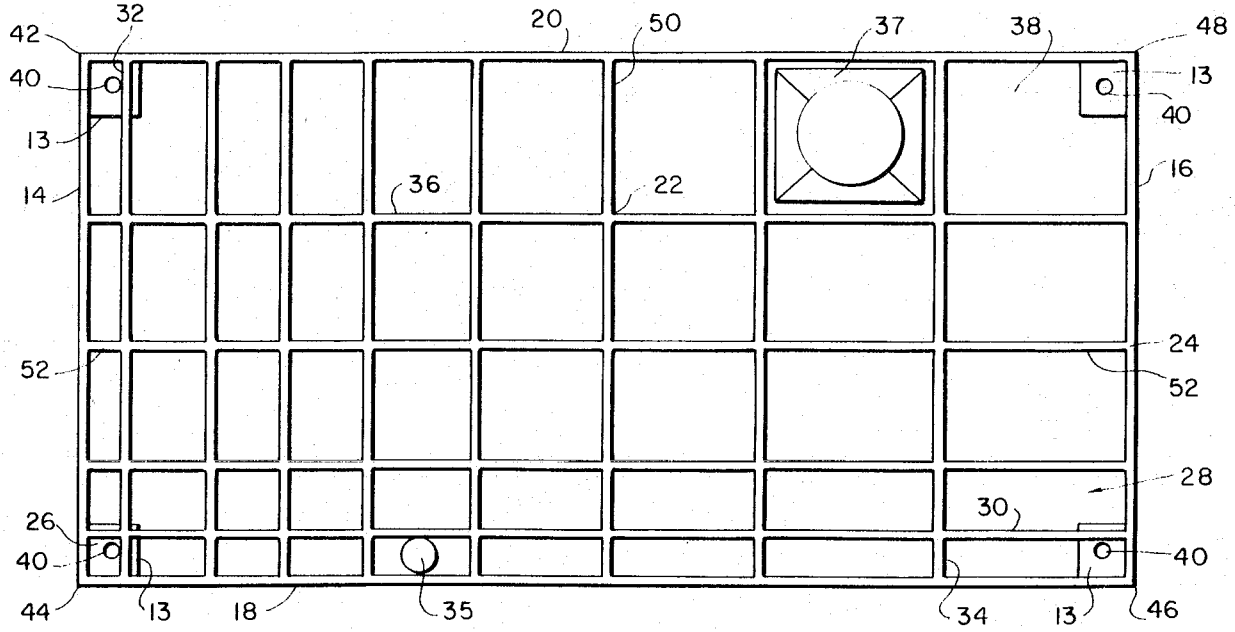
FIG. 4 is a plan view of the invention.

FIGS. 2 and 3 are side and end views, respectively, which show more clearly how the top edges of the vertical walls (except 14 and 18) slope upward from front side to back side and from front end to back end. FIG. 3 is presented in a slightly larger scale than FIG. 2. The increased spacing between adjacent vertical walls may be seen as one looks from left to right in FIG. 2 and from right to left in FIG. 3. FIG. 4, which is a plan view, shows clearly the size distribution of the compartments and how they increase in size as one looks from left to right and from front to rear.

Figure 6:
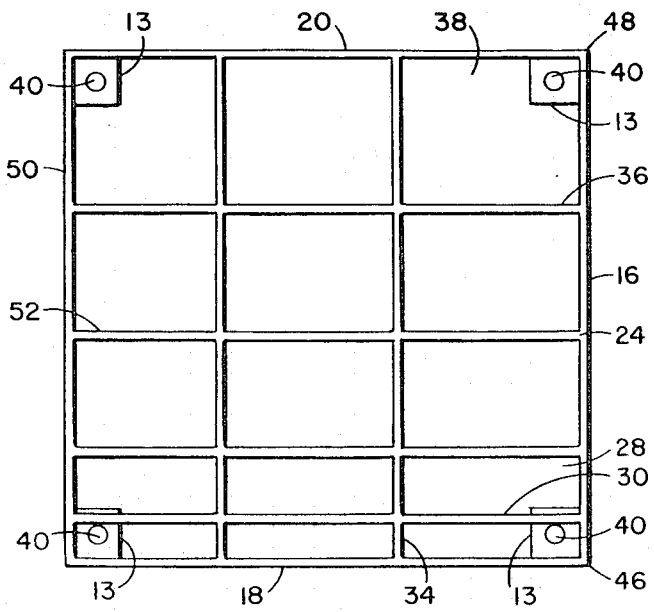
FIG. 6 is a top surface plan view of the higher half of a countertop "half module."
Figure 5:
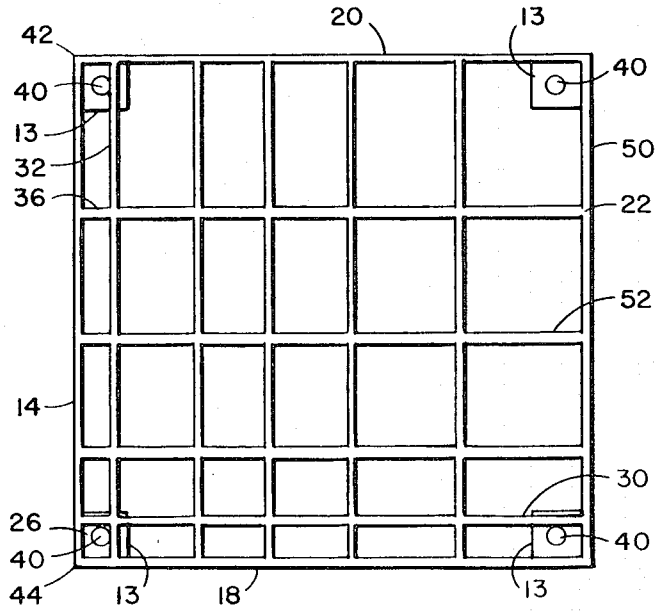
FIG. 5 is a top surface plan view of the lower half of a counter top "half module."
Figure 8:
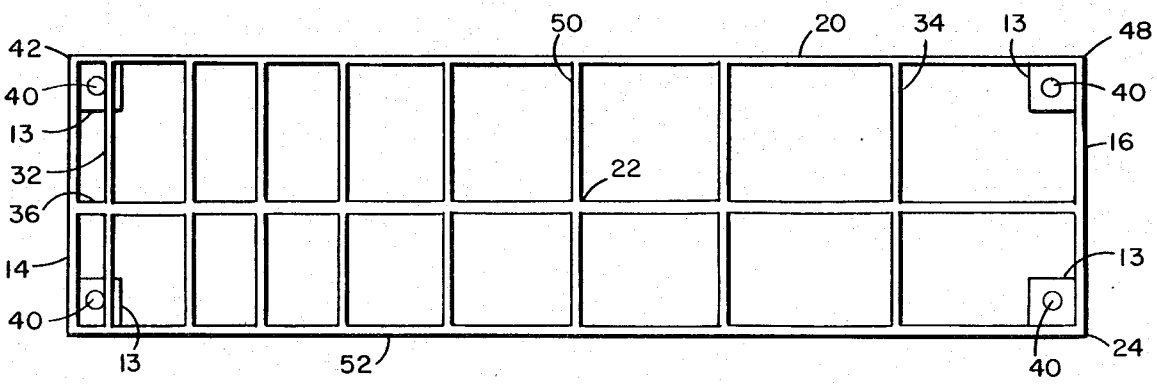
FIG. 8 is a top surface plan view of the higher half of a shelf "half module."
Figure 7:
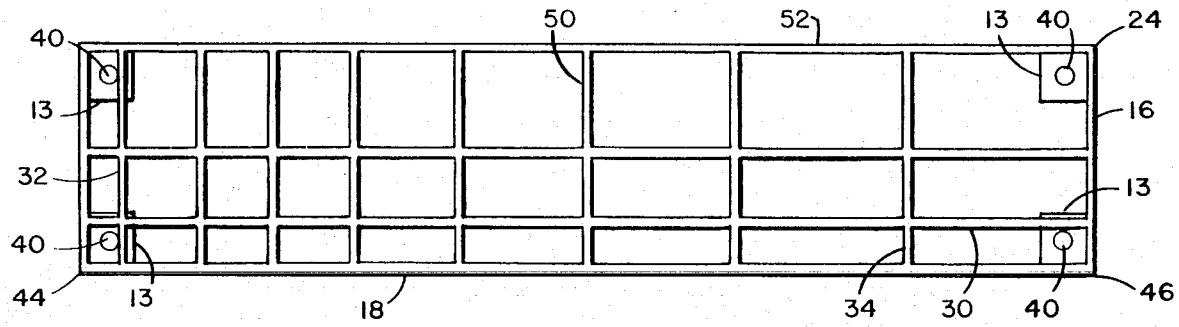
FIG. 7 is a top surface plan view of the lower half of a shelf "half module."

The top surface plan views of FIGS. 5 to 8, inclusive, show how the rack can be subdivided along latitudinal or longitudinal middle partition lines so that shelf top or counter top "half modules" can be provided. If the actual bottle size distribution is weighted in a lab toward one end of the proportion scale or the other, a proper assortment of "half modules" could be selected to accommodate the user requirements. FIGS. 5 and 6 show the lower and higher counter top "half modules," respectively, formed by dividing a rack 10 along latitudinal middle partition lines. Each half module has a vertical wall 50 corresponding to vertical wall 50 in the full counter top module shown in FIG. 1 and additional feet 13 as needed to support the half module. FIGS. 7 and 8 show the lower and higher shelf "half modules," respectively, formed by dividing a rack 10 along longitudinal middle partition lines. Each shelf half module has a vertical wall 52 corresponding to vertical wall 52 in FIG. 1 and additional feet as mentioned above to support the counter top half modules.

In operation, round or square shaped laboratory bottles or glass containers are inserted into the compartments which most closely match their diameter or width and their height.

The present invention is believed to be the first laboratory glassware rack specifically designed for seismic safety, as well as the first laboratory glassware rack to be designed mathematically to accommodate actual sizes and shapes of laboratory bottles in precisely the mathematically correct proportions and approximate numbers. The hyperbolic-paraboloid top curved surface provides a topological solution to the mathematic requirements for safety of bottles of chemicals subjected to an earthquake of medium or severe intensity, since this three-dimensional curved top surface integrates height and width requirements for each container. Use of this device in areas where earthquakes may occur will provide a greater measure of security for laboratory chemicals than has ever been available before. The device may be fabricated in a full counter top module as shown in FIG. 1 or it may also be provided in half modules by separating the module shown in FIG. 1 in half from right to left (see FIGS. 5 and 6) or from front to rear (see FIGS. 7 and 8). Although injection molded polypropene is considered the best construction material for ease of production and for high chemical resistance, the device may also be made of polycarbonate material, which has its own advantages, such as high structural strength and a high degree of transparency. Another preferred structural material having high strength is stainless steel.

What is claimed is:

1. A rectangular rack for restraining the lateral motion of a diverse collection of laboratory glassware containers having bottom surfaces resting on a support beneath the rack, said rack comprising:

a base comprising a plurality of individual feet, each foot having an orifice therethrough adapted to receive a fastener so that said feet may be anchored to said support;

a self-supporting rectangular matrix mounted on top of said base with all of said matrix elevated from the bottom surface of said base so that a liquid may be flushed between said support and said matrix to carry away any spillage from said containers, said matrix comprising:

a first plurality of vertical parallel longitudinal walls, a second plurality of vertical parallel lateral walls, said second plurality of walls being perpendicular to said first plurality of walls and intersecting therewith to form a plurality of rectangular compartments open at the top and bottom and adapted to surround and restrain glassware containers placed therein while the bottom surfaces of the containers rest on said support, said intersecting walls being of the same height at the point of intersection, said walls of said matrix including a front wall, a rear wall, a left-most wall and a right-most wall;

said front and left-most walls being rectangularly shaped whereas the other walls have a linear-sloped upper edge where the slope increases positively from left to right for the longitudinal walls and increases positively from front to rear for the lateral walls, the slopes of said sloped longitudinal walls successively increasing from the front to the rear of the matrix and the slopes of the sloped lateral walls successively increasing from the left to the right of the matrix, the upper edges of the walls thereby collectively defining a curved surface and the spaces between adjacent longitudinal walls being successively larger in the direction from the front to rear of the matrix, and the spaces between adjacent lateral walls being successively larger in the direction from the left to the right of the matrix whereby the size of the matrix rectangular compartments progressively increase in height and girth from the front-left corner to the rear-right corner.

2. A rectangular rack for restraining the lateral motion of a varied group of laboratory glassware containers whose bases rest on a support beneath the rack, said rack comprising:

a rigid rectangular matrix comprising a plurality of vertical parallel longitudinal walls, a plurality of vertical parallel lateral walls, said plurality of lateral walls being perpendicular to said plurality of longitudinal walls and intersecting therewith to form a plurality of rectangular compartments open at the bottom and the top and adapted to encircle and restrain glassware containers placed therein while the bases of the containers stand on said support, said intersecting walls being of the same height at the point of intersection, said walls of said matrix including a front wall, a rear wall, a left-most wall and a right-most wall;

said front and left-most walls being of equal height and each having a rectangular configuration, said longitudinal walls except said front one linearly increasing in a left-to-right direction, each one at a different rate, said lateral walls except said left-most wall linearly increasing in height in a front-to-rear direction, each one at a different rate, said height rates for said longitudinal walls increasing progressively in a front-to-rear direction, said height rates for said lateral walls increasing progressively in a left-to-right direction;

the spaces between adjacent longitudinal walls being progressively greater in the direction from front to rear of the matrix, and the spaces between adjacent lateral walls being progressively greater in the direction from the left to the right of the matrix, the top edges of said matrix walls being linear and collectively defining a hyperbolic-paraboloid surface; and a plurality of feet, each foot having a passageway therethrough adapted to receive a fastener so that said feet may be secured to said support, said matrix rigidly mounted on top of said feet with all of said matrix elevated from the bottom sides of said feet so that a liquid may be flushed between said support and said matrix to carry away any spillage from said containers.

* * * * *